US007639569B2

(12) United States Patent
Yano et al.

(10) Patent No.: US 7,639,569 B2
(45) Date of Patent: Dec. 29, 2009

(54) EQUIPMENT CASE, WRIST WATCH CASE, AND RADIO CONTROLLED WATCH

(75) Inventors: Junro Yano, Hamura (JP); Takanobu Kanezashi, Hachioji (JP)

(73) Assignee: Casio Computer Co., Ltd., Tokyo (JP)

( * ) Notice: Subject to any disclaimer, the term of this patent is extended or adjusted under 35 U.S.C. 154(b) by 24 days.

(21) Appl. No.: 11/880,639

(22) Filed: Jul. 23, 2007

(65) Prior Publication Data

US 2008/0025152 A1 Jan. 31, 2008

(30) Foreign Application Priority Data

Jul. 27, 2006 (JP) ..... 2006-204120

(51) Int. Cl.
*G04C 11/02* (2006.01)
*G04C 23/02* (2006.01)
*A44C 5/00* (2006.01)

(52) U.S. Cl. ..... 368/47; 368/88; 368/281

(58) Field of Classification Search ..... 368/10, 368/47; 343/718, 788; 455/757.7, 575.7; 361/679.03, 728, 752
See application file for complete search history.

(56) References Cited

U.S. PATENT DOCUMENTS 4,479,724 A * 10/1984 Matsumoto et al. ..... 368/291
6,411,569 B1 * 6/2002 Megner et al. ..... 368/43
6,825,751 B1 * 11/2004 Kita et al. ..... 340/5.61
6,992,952 B2 * 1/2006 Endo et al. ..... 368/10
7,027,359 B2 * 4/2006 Apotheloz et al. ..... 368/10
7,126,548 B2 * 10/2006 Yano et al. ..... 343/702
7,396,155 B2 * 7/2008 Oguchi ..... 368/298
2004/0042344 A1 * 3/2004 Motokawa et al. ..... 368/47
2005/0122270 A1 * 6/2005 Yano et al. ..... 343/718
2006/0109188 A1 * 5/2006 Ikeda et al. ..... 343/718
2006/0126438 A1 * 6/2006 Itou et al. ..... 368/47

FOREIGN PATENT DOCUMENTS

JP 63-042377 Y2 11/1988
JP 63-42377 Y2 11/1988
JP 2001-033571 A 2/2001
JP 2006-112866 A 4/2006

OTHER PUBLICATIONS

Chinese Office Action (and English translation thereof) dated May 23, 2008, issued in a counterpart Chinese Application.

* cited by examiner

*Primary Examiner*—Vit W Miska
(74) *Attorney, Agent, or Firm*—Frishauf, Holtz, Goodman & Chick, P.C.

(57) ABSTRACT

An equipment case for use in an electronic device such as a radio wave wrist watch case comprises a metal case body, a metal back cover, a spacer member, and a ring member. The case body has an opening and houses an antenna inside the case body. The back cover covers the opening of the case body. The spacer member is provided between the case body and the back cover, and increases the electric resistance between the case body and the back cover. The ring member is screwed to the case body, and fixes the back cover to the case body by pressing the back cover against the spacer member towards the case body.

16 Claims, 5 Drawing Sheets

EQUIPMENT CASE, WRIST WATCH CASE, AND RADIO CONTROLLED WATCH

BACKGROUND OF THE INVENTION

1. Field of the Invention

The present invention relates to equipment cases, wrist watch cases, and radio controlled watches.

2. Description of the Related Art

In the conventional art a radio controlled watch is known in which, for example, an antenna for receiving standard time radio waves is housed. The radio controlled watch corrects its time based on the standard time radio waves received by the antenna.

In timepieces such as the radio controlled watch above, when both the case body and the back cover (lid) are formed of metal, eddy current flux can be generated between the case body and the back cover. When this occurs, the signal receiving sensitivity of the antenna is lowered.

Accordingly, as a technology to solve this problem, in U.S. Pat. No. 7,126,548 and Japanese Patent Application KOKAI Publication No. 2006-112866, the installation of a spacer member between the metal case body and the metal back cover is described. As a result of this technology, current flux between the case body and the back cover is suppressed by the spacer member, thereby suppressing the lowering of the signal receiving sensitivity of the antenna.

However, when the back cover is fixed to the case body with the interposing spacer members via press fitting or screws, the securing force of the back cover is often weakened. When this occurs, high water resistance, for example, cannot be obtained.

In addition, a technology for strengthening the securing force of the back cover and additionally suppressing in part eddy current is described in U.S. Patent Application Publication No. 2006/0109188. In this technology, screw members are formed respectively on a portion of the periphery of the metal back cover and a portion of the inner surface of the metal case body. By threading and screwing these screw members together, the back cover is attached to the case body. Furthermore, the screw heads of the screw members formed on the case body are partially cut. As a result of this configuration, the technology described in U.S. Patent Application Publication No. 2006/0109188 reduces the surface contact area between the case body and the back cover, and partially suppresses eddy current.

However, in the technology described in U.S. Patent Application Publication No. 2006/0109188, although eddy current is suppressed, the more the screw heads are cut, the more the back cover securing force weakens.

SUMMARY OF THE INVENTION

The objective of the present invention is to provide an equipment case, wrist watch case, and radio controlled watch wherein, even if the case body and the cover are formed of metal, the lowering of the signal receiving sensitivity of the antenna housed inside the case is suppressed, and the cover is strongly fixed to the case body.

In order to achieve the above-described objectives, an equipment case in accordance with a first aspect of the present invention is provided with:

a metal case body with an opening, housing an antenna inside the case body;

a metal cover for covering the opening of the case body;

a spacer member for increasing the electric resistance between the case body and the cover, provided between the case body and the cover; and a ring member, screwed to the case body, for fixing the cover to the case body by pressing the cover against the spacer member towards the case body.

In addition, a wrist watch case in accordance with a second aspect of the present invention is provided with:

a metal case body with an opening, housing an antenna for receiving a standard time radio wave and a watch module for correcting time based on the standard time radio wave received by the antenna inside the case body;

a metal cover for covering the opening of the case body;

a spacer member for increasing the electric resistance between the case body and the cover, provided between the case body and the cover; and a ring member, screwed to the case body, for fixing the cover to the case body by pressing the cover against the spacer member towards the case body.

In addition, a radio controlled watch in accordance with a third aspect of the present invention is provided with:

a watch case, comprising:

a metal case body with an opening;

a metal cover for covering the opening of the case body;

a spacer member for increasing the electric resistance between the case body and the cover, provided between the case body and the cover; and a ring member, screwed to the case body, for fixing the cover to the case body by pressing the cover against the spacer member towards the case body;

an antenna for receiving a standard time radio wave, housed inside the watch case; and a watch module for correcting time based on the standard time radio wave received by the antenna, housed inside the watch case.

In the present invention, a spacer member for increasing the electric resistance between the metal case body and the metal cover is interposed between the case body and the cover. Consequently, when a magnetic field is generated at the antenna inside the case receiving radio waves, the eddy current generated as a result of the magnetic field generated by the antenna passing through the case body and the cover, in other words, the eddy current flux between the case body and the cover, is suppressed as a result of the present invention. As a result, even if the case body and the cover are formed of metal, the lowering of the signal receiving sensitivity of the antenna housed inside the case can be suppressed.

In addition, in the present invention, a ring member screwed to the case body presses the cover towards the case body and fixes it. Consequently, the cover is strongly fixed to the case body as a result of the present invention.

BRIEF DESCRIPTION OF THE DRAWINGS

These objects and other objects and advantages of the present invention will become more apparent upon reading of the following detailed description and the accompanying drawings in which.

DETAILED DESCRIPTION OF THE PREFERRED EMBODIMENTS

First Embodiment

A first embodiment of the present invention as applied to a radio wave wrist watch will now be described with reference to FIGS. 1-3.

Figure 1:
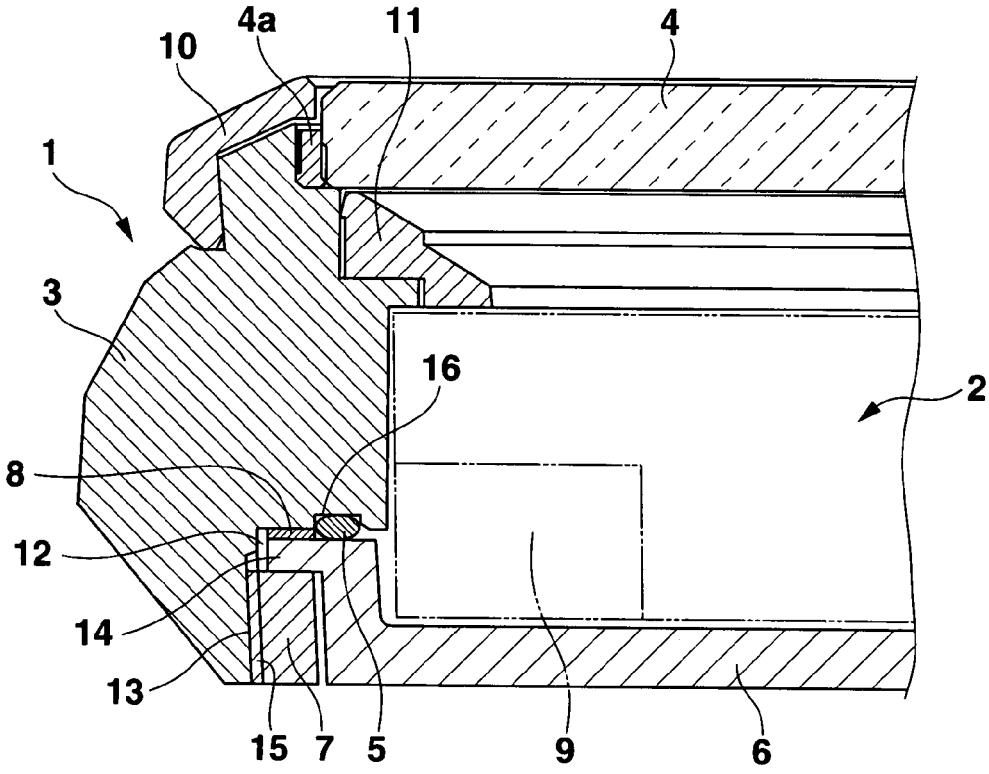
FIG. 1 is an enlarged cross section view showing the essential components of a radio wave wrist watch in accordance with the first embodiment of the present invention.
Figure 2:
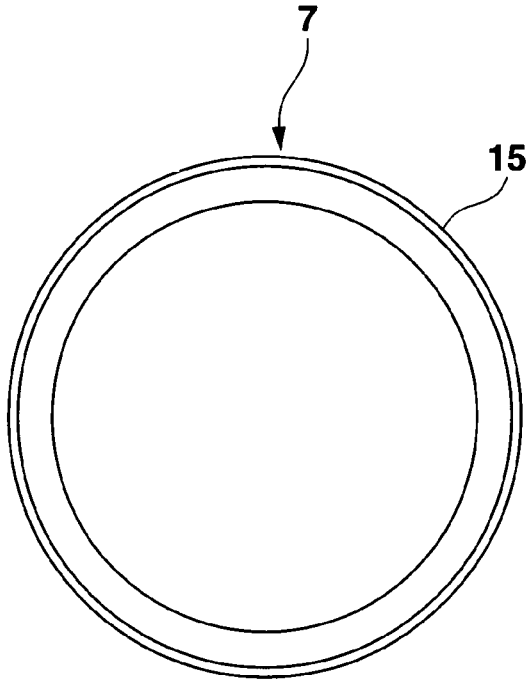
FIG. 2 is a plan view of the ring member shown in FIG. 1.

FIG. 1 is an enlarged cross section view showing the essential components of a radio wave wrist watch in accordance with the first embodiment of the present invention. FIG. 2 is a plan view of the ring member shown in FIG. 1. FIG. 3 is an enlarged cross section view of the essential components shown in FIG. 1.

As shown in FIG. 1, the radio wave wrist watch is provided with a wrist watch case 1 and a watch module 2.

As shown in FIG. 1, the wrist watch case 1 comprises a case body 3, a watch glass 4, a waterproof packing 4*a*, a waterproof packing 5, a back cover 6, a ring member 7, a spacer member 8, a bezel 10, and a corner member 11. The case body 3 has top and bottom openings, and houses a watch module 2 in its interior. The watch glass 4 is fitted onto the top central opening of the case body 3 with the interposing waterproof packing 4*a*. The back cover 6 is attached onto the bottom (back side) opening of the case body 3 with the interposing waterproof packing 5. The ring member 7 fixes the back cover 6 to the case body 3. The spacer member 8 provides insulation between the case body 3 and the back cover 6. In this configuration, a watch band (not shown in the drawings) for wearing the wrist watch case 1 on the arm is attached to the case body 3.

The watch module 2 is provided with the various electronic components such as a time display component and LSI necessary for timekeeping functions, and an antenna 9 for receiving standard time radio waves. The watch module 2 is configured such that it corrects its time based on the standard time radio waves received by the antenna 9. In this configuration, the time display component may comprise analog movement for indicating the time by moving at least one watch hand, or alternatively may comprise flat panel type display elements for indicating the time and/or other information electro-optically. It should be appreciated that the time display component may also comprise both analog movement and electro-optic display elements.

The antenna 9 is a bar antenna, comprising a core and a coil. The core is bar-shaped and formed of magnetic materials with high relative magnetic permeability and low conductivity, such as amorphous metal or ferrite. The coil is a conductive wire such as copper wound around the core. When the antenna 9 is placed in a magnetic field generated by electromagnetic waves, the magnetic flux of the magnetic field is concentrated more at the core with high relative magnetic permeability rather than the surrounding space, and thereby interlinks with the coil (flux linkage). As a result, induced electromotive force is generated such that a magnetic field opposing the flux variation is generated in the coil.

In addition, the circuit of the watch module 2 is configured having a control component, a signal receiving circuit, and a clocking circuit. The control component conducts general control of the circuits. The signal receiving circuit detects the induced electromotive force generated by the coil of the antenna 9, and retrieves from the electromagnetic wave the standard time data. The clocking circuit measures the present time based on an oscillator. In the watch module 2 with a circuit configuration like the above, the control component corrects the present time measured by the clocking circuit based on the standard time data retrieved in the signal receiving circuit. Furthermore, the control component controls the time display component such that the corrected present time is indicated (or displayed).

Also, the case body 3 is formed of a high-strength metal such as stainless steel or titanium. As shown in FIG. 1, a decorative bezel 10 is attached at the surface of the top outer periphery of the case body 3. In addition, underneath the watch glass 4 inside the case body 3, a corner member 11 is disposed along the surface of the inner periphery of the case body 3. In addition, on the surface of the bottom periphery of the case body 3, a notch recess portion 12 is provided continuously along the surface of the inner periphery of the case body 3, as shown in FIG. 1. On the inner periphery surface of the notch recess portion 12, female threads 13 are provided.

Meanwhile, the back cover 6 is of approximately discoid shape, and similarly to the case body 3, is formed of a high-strength metal such as stainless steel or titanium. In this configuration, the back cover 6 is inserted into the notch recess portion 12 installed along the inner periphery surface of the case body 3 such that the outer periphery of the back cover 6 does not contact the case body 3, as shown in FIGS. 1 and 3. On the top outer periphery of the back cover 6, a collar part 14 is provided protruding towards the outer periphery. The case body 3 and the back cover 6 are configured such that a ring-shaped gap is provided underneath the collar part 14 and between the outer periphery surface of the back cover 6 and the inner periphery surface of the notch recess portion 12 of the case body 3.

The ring member 7 consists of a non-metallic material having insulating properties, such as synthetic resin or ceramic. In addition, the whole of the ring member 7 is formed in a ring shape, and upon the outer periphery surface thereof are provided male threads 15, as shown in FIGS. 1 to 3. The ring member 7 is inserted into the ring-shaped gap provided between the outer periphery surface of the back cover 6 and the inner periphery surface of the notch recess portion 12 of the case body 3. In addition, the ring member 7 is attached to the case body 3 by threading and screwing the male threads 15 of the ring member 7 into the female threads 13 provided on the inner periphery surface of the notch recess portion 12 of the case body 3. The top surface of the ring member 7 attached to the case body 3 presses the collar part 14 of the back cover 6 towards the bottom surface of the notch recess portion 12 of the case body 3. As a result, the back cover 6 is fixed to the case body 3.

Figure 3:
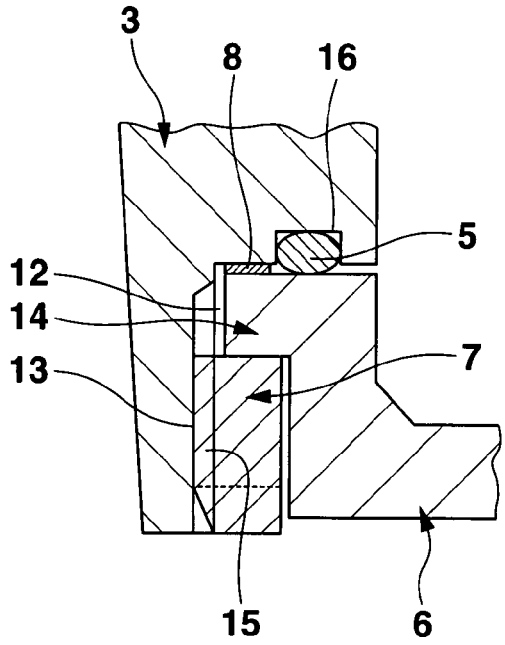
FIG. 3 is an enlarged cross section view of the essential components shown in FIG. 1.

In this configuration, a spacer member 8 and a waterproof packing 5 are provided between the top surface of the collar part 14 of the back cover 6 and the bottom surface of the notch recess portion 12 of the case body 3, as shown in FIGS. 1 and 3. Specifically, the top surface of the ring member 7 presses the collar part 14 of the back cover 6 against the spacer member 8 and the waterproof packing 5 and towards the bottom surface of the notch recess portion 12 of the case body 3. The spacer member 8 is a tabular ring having insulating properties. In addition, the spacer member 8 is disposed between the top surface on the outer periphery of the collar part 14 of the back cover 6 and the bottom surface on the outer periphery of the notch recess portion 12 of the case body 3. The spacer member 8 disposed in this way provides electrical insulation between the metal case body 3 and the metal back cover 6. In addition, the spacer member 8 is formed as a ring shape running continuously along the outer periphery of the back cover 6. As a result, the spacer member 8 can be easily disposed upon the top surface of the collar part 14 pressed towards the case body 3.

The whole of the waterproof packing 5 is formed in a ring shape, and consists of a material having water-resistant properties and insulating properties, such as rubber. As shown in FIGS. 1 and 3, the waterproof packing 5 is disposed inside a ring-shaped groove 16 formed continuously on the bottom surface of the notch recess portion 12 of the case body 3, and the bottom edge of the waterproof packing 5 makes pressure contact with the top surface of the collar part 14 of the back cover 6. The waterproof packing 5 disposed in this way prevents water from entering the device between the case body 3 and the back cover 6. In this way, the waterproof packing 5 and the spacer member 8 are provided continuously along the outer periphery of the back cover 6 between the top surface of the collar part 14 of the back cover 6 and the bottom surface of the notch recess portion 12 of the case body 3. In addition, the back cover 6 is inserted and fixed into the notch recess portion 12 of the case body 3 such that the outer periphery surface of the collar part 14 of the back cover 6 and the inner periphery surface of the notch recess portion 12 of the case body 3 do not contact. Consequently, the case body 3 and the back cover 6 are mutually non-contacting.

In the wrist watch case 1 in accordance with the first embodiment, the ring member 7 is screwed to the inner periphery surface of the metal case body 3 housing in its interior the antenna 9. As a result of this configuration, the collar part 14 of the metal back cover 6 is pressed towards the bottom surface of the notch recess portion 12 of the metal case body 3, thereby securing the back cover 6 to the case body 3. In this configuration, since a spacer member 8 is provided between bottom surface of the notch recess portion 12 of the case body 3 and the top surface of the collar part 14 of the back cover 6, there is significant electric resistance between the case body 3 and the back cover 6, and the case body 3 and back cover 6 are mutually insulated. Consequently, as a result of the first embodiment, when a magnetic field is generated at the antenna 9 inside the case body 3 receiving electromagnetic waves, the eddy current generated as a result of the magnetic field generated by the antenna 9 passing through the case body 3 and the back cover 6, in other words, the eddy current flux between the case body 3 and back cover 6, is suppressed. As a result, even if the case body 3 and the back cover 6 are formed of metal, lowering of the signal receiving sensitivity of the antenna 9 housed inside the wrist watch case 1 is prevented.

In addition, in the first embodiment, the ring member 7 is formed of a non-metallic material such as synthetic resin or ceramic. As a result, electrical conduction between the metal case body 3 and the metal back cover 6 via the interposed ring member 7 is prevented. In other words, as a result of the ring member 7, insulation is reliably provided between the case body 3 and the back cover 6. Consequently, the ring member 7 also contributes to the suppression of eddy current flux between the case body 3 and the back cover 6. In addition, a collar part 14 is provided on the outer periphery surface of the back cover 6, and a notch recess portion 12 is also provided on the case body 3, a portion of the outer periphery of the back cover 6 including the collar part 14 being inserted into the notch recess portion 12. Consequently, as a result of the ring member 7, the collar part 14 of the back cover 6 is reliably pressed towards the bottom surface of the notch recess portion 12 of the case body 3, thereby firmly securing the back cover 6 to the case body 3. In addition, the back cover 6 is compactly attached to the case body 3, and as a result it is possible to miniaturize the case as a whole.

In the first embodiment, the male threads 15 of the non-metallic ring member 7 are threaded and screwed into the female threads 13 of the case body 3, thereby causing the top surface of the ring member 7 to make contact with the metal back cover 6 and press the back cover 6 against the metal case body 3. Between the surface of the back cover 6 and the surface of the case body 3 being mutually pressed against the other by the ring member 7, the waterproof packing 5 and the spacer member 8 are disposed.

Both the waterproof packing 5 and the spacer member 8 have insulating properties. Consequently, between the back cover 6 and the case body 3, the highly electrically resistive ring member 7, the spacer member 8, and the waterproof packing 5 are interposed, thereby creating a large preventative effect on the formation of electrical current loops, and suppressing the lowering of the signal receiving sensitivity of the antenna 9.

In addition, by screwing together the ring member 7 and the case body 3, the ring member 7 is firmly attached to the case body 3. Moreover, the ring member 7, being firmly attached to the case body 3, strongly presses the back cover 6 against the case body 3 and fixes it.

In this way, as a result of the first embodiment, even if the case body 3 and the back cover 6 are formed of metal, lowering of the signal receiving sensitivity of the antenna 9 housed inside the wrist watch case 1 is suppressed, and additionally, the back cover 6 is strongly fixed to the case body 3.

In addition, as a result of the first embodiment, the interior of the case body 3 to which is attached the back cover 6 has high water-resistant properties, due to the waterproof packing 5 disposed between the case body 3 and the back cover 6 strongly fixed to the case body 3.

Moreover, since the ring member 7 screwed to the case body 3 is non-metallic, it is not necessary to cut screw heads in order to suppress eddy current, and therefore eddy current can be suppressed while strongly maintaining the force securing the back cover.

Figure 4:
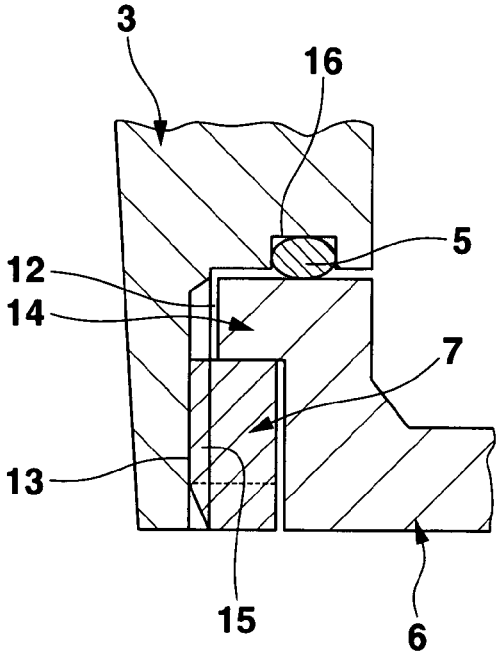
FIG. 4 is an enlarged cross section view showing the essential components of a radio wave wrist watch in accordance with a variant of the first embodiment of the present invention.

In the foregoing description of the first embodiment, the configuration wherein a spacer member 8 is provided between the back cover 6 and the case body 3 was described. However, the present invention is not limited to such a configuration, and, for example, the case body 3 and the back cover 6 may be mutually insulated by the waterproof packing 5 without providing the spacer member 8. FIG. 4 shows the essential components of a radio wave wrist watch in accordance with a variant of the first embodiment. As shown in FIG. 4, in one variant, the waterproof packing 5 is disposed between the back cover 6 and the case body 3 such that the top surface of the collar part 14 of the back cover 6 and the bottom surface of the notch recess portion 12 of the case body 3 are mutually non-contacting. As a result, a gap is provided between the top surface of the collar part 14 of the back cover 6 and the bottom surface of the notch recess portion 12 of the case body 3, thereby providing insulation between the case body 3 and the back cover 6. As a result of this kind of configuration, the waterproof packing 5 may also act as the spacer member 8 and provide insulating properties, thereby eliminating the need for an additional component like the spacer member 8. Consequently, the number of device components can be reduced, and in addition the assembly work can be simplified, and as a result costs can be lowered.

In addition, in the foregoing description of the first embodiment, the waterproof packing 5, the ring member 7, and the spacer member 8 were described as being formed of materials having insulating properties. However, the waterproof packing 5, the ring member 7, and the spacer member 8 may also be formed of materials having higher electric resistance than the case body 3 and the back cover 6. Even in such a configuration, eddy current is suppressed when compared to the configuration wherein the case body 3 and the back cover 6 are contacting. It should be appreciated that the degree to which the waterproof packing 5, the ring member 7, and the spacer member 8 are formed having greater electric resistance values, in other words as semiconductors rather than conductors, or insulators (non-conductors) rather than semiconductors, will determine the extent of the eddy current suppression effects.

Furthermore, the ring member 7 and the spacer member 8 may also be formed of materials having approximately the same electric resistance values as the case body 3 or the back cover 6. Even in a configuration such as this, since the ring member 7 and the spacer member 8 are interposed between the case body 3 and the back cover 6, the electrical contact resistance between the case body 3 and the back cover 6 is greater and eddy current is suppressed as compared to the configuration wherein the case body 3 and the back cover 6 are in direct contact.

In addition, in order to increase the electric resistance between the case body 3 and the back cover 6, the contact area of the ring member 7 with either of the case body 3 and the back cover 6 may be reduced. In such a configuration, the ring member 7 may be formed of materials with lower electric resistance, to the extent that the electric resistance between the case body 3 and the back cover 6 is still greater than that of the configuration wherein the case body 3 and the back cover 6 are in direct contact.

Second Embodiment

A second embodiment of the present invention as applied to a radio wave wrist watch will now be described with reference to FIG. 5. Furthermore, for the configuration portions of the radio wave wrist watch in accordance with the second embodiment that are identical to configuration portions of the radio wave wrist watch in accordance with the first embodiment illustrated in FIGS. 1-3, identical reference numbers will be used, and the description of the portions will be omitted herein for the sake of brevity.

A wrist watch case 20 of the radio wave wrist watch in accordance with the second embodiment differs from the wrist watch case 1 of the radio wave wrist watch in accordance with the first embodiment in a ring member 21 and an auxiliary spacer member 22. In the second embodiment, the ring member 21 is formed of metal. In addition, between the ring member 21 and the back cover 6, an auxiliary spacer member 22 having insulating properties is provided.

Specifically, the ring member 21 consists of a high-strength metal such as stainless steel or titanium, in the same way as the case body 3 and the back cover 6. In addition, the whole of the ring member 21 is formed in a ring shape, and upon the outer periphery surface thereof are provided male threads 15. As shown in FIG. 5, the ring member 21 is inserted into the ring-shaped gap provided between the outer periphery surface of the back cover 6 and the inner periphery surface of the notch recess portion 12 of the case body 3, such that the inner periphery surface of the ring member 21 does not contact the outer periphery surface of the back cover 6. In this configuration, the male threads 15 of the ring member 21 are threaded and screwed into the female threads 13 provided on the inner periphery surface of the notch recess portion 12 of the case body 3, thereby attaching the ring member 21 to the case body 3. The top surface of the ring member 21 attached to the case body 3 presses the collar part 14 of the back cover 6 towards the bottom surface of the notch recess portion 12 of the case body 3. As a result, the back cover 6 is fixed to the case body 3.

The auxiliary spacer member 22 is a tabular ring having insulating properties. In addition, the auxiliary spacer member 22 is disposed between the top surface of the ring member 21 and the bottom surface of the collar part 14 of the back cover 6, as shown in FIG. 5. The auxiliary spacer member 22 disposed in this way provides electrical insulation between the metal ring member 21 and the metal back cover 6. In addition, the auxiliary spacer member 22 is formed as a ring shape running continuously along the outer periphery of the back cover 6. As a result, the auxiliary spacer member 22 can be easily disposed upon the bottom surface of the collar part 14.

Figure 5:
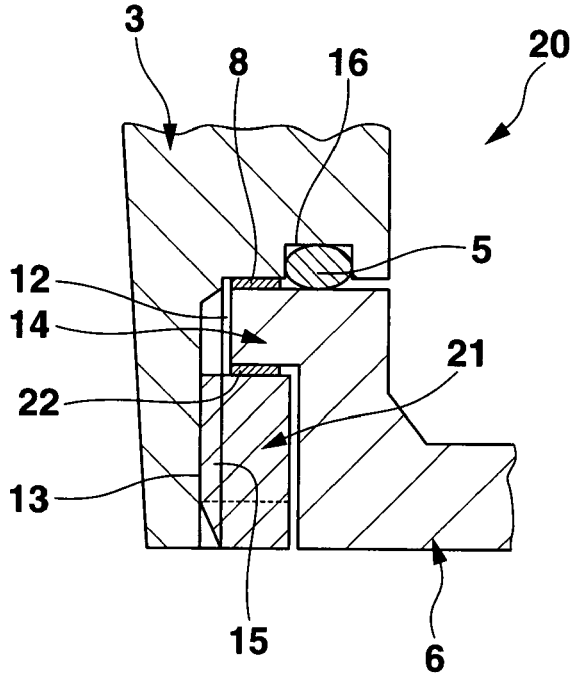
FIG. 5 is an enlarged cross section view showing the essential components of a radio wave wrist watch in accordance with the second embodiment of the present invention.

Furthermore, in the second embodiment, as in the first embodiment, a spacer member 8 and a waterproof packing 5 are provided between the top surface of the collar part 14 of the back cover 6 and the bottom surface of the notch recess portion 12 of the case body 3, as shown in FIG. 5. The spacer member 8 provides electrical insulation between the metal case body 3 and the metal back cover 6. In addition, the waterproof packing 5 prevents water from entering the device between the case body 3 and the back cover 6.

As also in the first embodiment, in the wrist watch case 20 in accordance with the second embodiment, the spacer member 8 is provided between the bottom surface of the notch recess portion 12 of the case body 3 and the top surface of the collar part 14 of the back cover 6. In the second embodiment in particular, the insulating auxiliary spacer member 22 is provided between the bottom surface of the collar part 14 of the back cover 6 and the top surface of the ring member 21. Consequently, as a result of the second embodiment, even if the ring member 21 is formed of metal, electrical conduction between the case body 3 and the back cover 6 via the interposed ring member 21 is prevented by the auxiliary spacer member 22. In other words, when a magnetic field is generated at the antenna 9, eddy current flux between the case body 3 and the back cover 6 is suppressed. As a result, even if the case body 3, the back cover 6, and the ring member 21 are all formed of metal, lowering of the signal receiving sensitivity of the antenna 9 housed inside the wrist watch case 20 is prevented.

Figure 6:
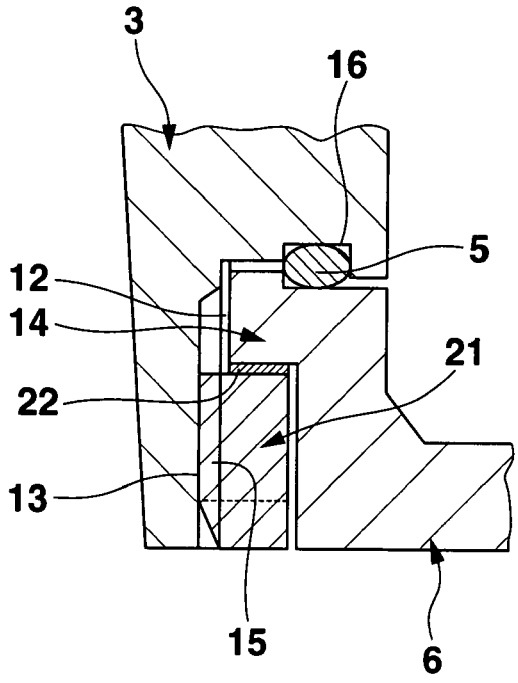
FIG. 6 is an enlarged cross section view showing the essential components of a radio wave wrist watch in accordance with a first variant of the second embodiment of the present invention.

In the foregoing description of the second embodiment, the configuration wherein a spacer member 8 is provided between the back cover 6 and the case body 3 was described. However, the present invention is not limited to such a configuration, and, for example, the case body 3 and the back cover 6 may be mutually insulated by the waterproof packing 5 without providing the spacer member 8. FIG. 6 shows the essential components of a radio wave wrist watch in accordance with a first variant of the second embodiment. As shown in FIG. 6, in the first variant, the waterproof packing 5 is disposed between the back cover 6 and the case body 3 such that the top surface of the collar part 14 of the back cover 6 and the bottom surface of the notch recess portion 12 of the case body 3 are mutually non-contacting. As a result, even in a configuration such as this, a gap is provided between the top surface of the collar part 14 of the back cover 6 and the bottom surface of the notch recess portion 12 of the case body 3, thereby providing insulation between the case body 3 and the back cover 6.

Figure 7:
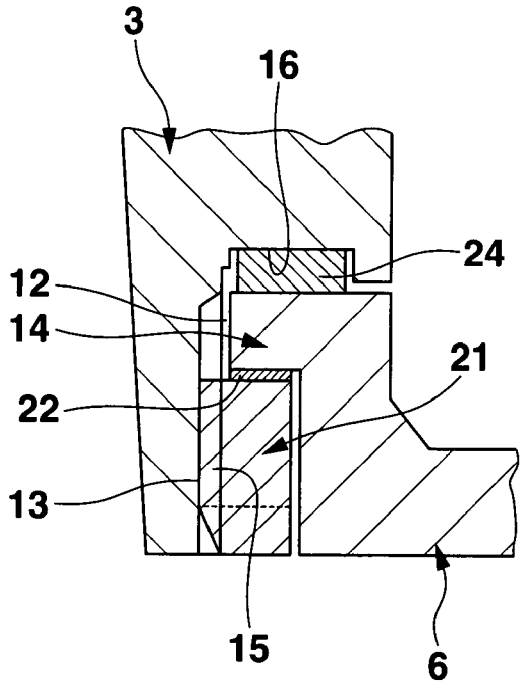
FIG. 7 is an enlarged cross section view showing the essential components of a radio wave wrist watch in accordance with a second variant of the second embodiment of the present invention.

In addition, FIG. 7 shows the essential components of a radio wave wrist watch in accordance with a second variant of the second embodiment. As shown in FIG. 7, the radio wave wrist watch in accordance with the second variant is provided with a waterproof packing 24 formed in a tabular ring shape. Furthermore, the waterproof packing 24 is disposed between the back cover 6 and the case body 3 such that the top surface of the collar part 14 of the back cover 6 and the bottom surface of the notch recess portion 12 of the case body 3 are mutually non-contacting. As a result, even in a configuration such as this, a gap is provided between the top surface of the collar part 14 of the back cover 6 and the bottom surface of the notch recess portion 12 of the case body 3, thereby providing insulation between the case body 3 and the back cover 6.

The first and second variants described above have functional advantages equivalent to those of the second embodiment. In particular, in the first and second variants of the second embodiment, as in the variant of the first embodiment shown in FIG. 4, the waterproof packing 5 and 24 may also act as the spacer member 8 and provide insulating properties, thereby eliminating the need for an additional component like the spacer member 8. Consequently, the number of device components can be reduced, and in addition the assembly work can be simplified, and as a result costs can be lowered.

In addition, in the foregoing description of the second embodiment, the waterproof packing 5, the spacer member 8, and the auxiliary spacer member 22 were described as being formed of materials having insulating properties. However, the waterproof packing 5 and the spacer member 8 may also be formed of materials having higher electric resistance than the case body 3 and the back cover 6, and the auxiliary spacer member 22 may also be formed of materials having higher electric resistance than the back cover 6 and the ring member 21. Even in such a configuration, eddy current is suppressed when compared to the configuration wherein the case body 3 and the back cover 6 are contacting. It should be appreciated that the degree to which the waterproof packing 5, the spacer member 8, and the auxiliary spacer member 22 are formed having greater electric resistance values, in other words as semiconductors rather than conductors, or insulators (non-conductors) rather than semiconductors, will determine the extent of the eddy current suppression effects.

Furthermore, the spacer member 8 and the auxiliary spacer member 22 may also be formed of materials having approximately the same electric resistance values as the case body 3 or the back cover 6. Even in a configuration such as this, since the spacer member 8 and the auxiliary spacer member 22 are interposed between the case body 3 and the back cover 6, the electrical contact resistance between the case body 3 and the back cover 6 is greater and eddy current is suppressed as compared to the configuration wherein the case body 3 and the back cover 6 are in direct contact.

Third Embodiment

A third embodiment of the present invention as applied to a radio wave wrist watch will now be described with reference to FIG. 8. Furthermore, for the configuration portions of the radio wave wrist watch in accordance with the third embodiment that are identical to configuration portions of the radio wave wrist watch in accordance with the second embodiment illustrated in FIG. 5, identical reference numbers will be used, and the description of the portions will be omitted herein for the sake of brevity.

A wrist watch case 30 of the radio wave wrist watch in accordance with the third embodiment differs from the wrist watch case 20 of the radio wave wrist watch in accordance with the second embodiment in a ring member 31 and a stepped recess portion 32. In the third embodiment, the ring member 31 is formed of metal. In addition, on the ring member 31 is provided the stepped recess portion 32, into which the collar part 14 of the back cover 6 is inserted.

Specifically, the ring member 31, like the ring member 21 of the second embodiment, consists of a high-strength metal such as stainless steel or titanium, the whole thereof being formed in a ring shape. On the other hand, the ring member 31 differs from the ring member 21 of the second embodiment in that the ring member 31 is formed such that the height thereof is approximately the same as the depth of the notch recess portion 12 of the case body 3, in other words, the height from the bottom surface of the back cover 6 to the top surface of the collar part 14 thereof. On the outer periphery surface of the ring member 31, male threads 15 are provided. In addition, on the inner periphery surface of the ring member 31, a stepped recess portion 32, into which the collar part 14 of the back cover 6 is inserted, is provided along the entire circumference of the ring member 31, as shown in FIG. 8.

Figure 8:
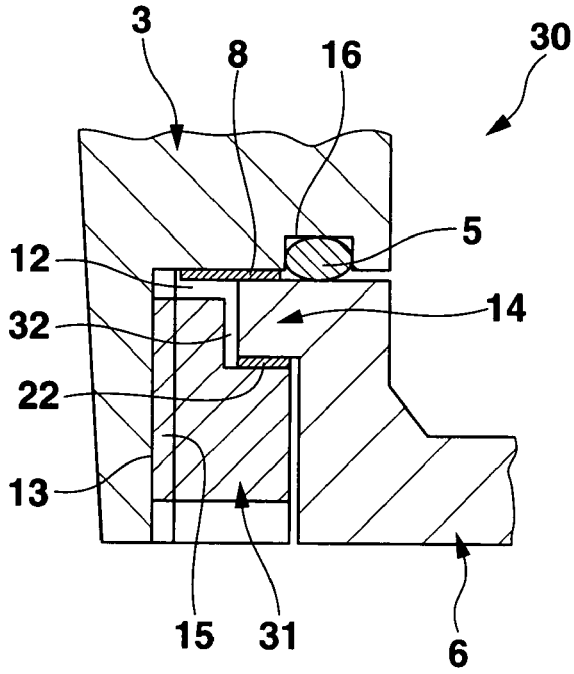
FIG. 8 is an enlarged cross section view showing the essential components of a radio wave wrist watch in accordance with the third embodiment of the present invention.

As shown in FIG. 8, the ring member 31 is inserted into the ring-shaped gap provided between the outer periphery surface of the back cover 6 and the inner periphery surface of the notch recess portion 12 of the case body 3, such that the inner periphery surface of the ring member 31 does not contact the outer periphery surface of the back cover 6, and furthermore such that the inner periphery surface of the stepped recess portion 32 of the ring member 31 does not contact the outer periphery surface of the collar part 14 of the back cover 6. In this configuration, the male threads 15 of the ring member 31 are threaded and screwed into the female threads 13 provided on the inner periphery surface of the notch recess portion 12 of the case body 3, thereby attaching the ring member 31 to the case body 3. The top surface of the stepped recess portion 32 of the ring member 31 attached to the case body 3 presses the collar part 14 of the back cover 6 towards the bottom surface of the notch recess portion 12 of the case body 3. As a result, the back cover 6 is fixed to the case body 3.

Also in this configuration, an auxiliary spacer member 22 having insulating properties is disposed between the top surface of the stepped recess portion 32 of the ring member 31 and the bottom surface of the collar part 14 of the back cover 6. In addition, a spacer member 8 and a waterproof packing 5 are provided between the top surface of the collar part 14 of the back cover 6 and the bottom surface of the notch recess portion 12 of the case body 3. The auxiliary spacer member 22 provides electrical insulation between the metal ring member 31 and the metal back cover 6. In addition, the spacer member 8 provides electrical insulation between the metal case body 3 and the metal back cover 6. Furthermore, the waterproof packing 5 prevents water from entering the device between the case body 3 and the back cover 6.

As also in the second embodiment, in the wrist watch case 30 in accordance with the third embodiment, the spacer member 8 is provided between the case body 3 and the back cover 6, and the insulating auxiliary spacer member 22 is provided between the back cover 6 and the ring member 31. Consequently, as a result of the third embodiment, eddy current generated as a result of the magnetic field generated by the antenna 9 passing through the case body 3 and the back cover 6, in other words, eddy current flux between the case body 3 and the back cover 6, is suppressed in the same way as the second embodiment. As a result, even if the case body 3, the back cover 6, and the ring member 31 are all formed of metal, lowering of the signal receiving sensitivity of the antenna 9 housed inside the wrist watch case 30 is prevented.

In the wrist watch case 30 in particular, the ring member 31 is formed such that the height thereof is approximately the same as the depth of the notch recess portion 12 of the case body 3, and a stepped recess portion 32, into which the collar part 14 of the back cover 6 is inserted, is provided upon the inner periphery surface of the ring member 31. Consequently, the male threads 15 upon the outer periphery surface of the ring member 31 can be formed of a significant length. As a result, since the threading area of the ring member 31 corresponding to the female threads 13 of the case body 3 can be increased, the back cover 6 is more reliably and more strongly fixed to the case body 3 by the ring member 31. In addition, the back cover 6 is compactly attached to the case body 3, and as a result it is possible to miniaturize the case as a whole.

In the foregoing descriptions of the first, second, and third embodiments and variants thereof, configurations wherein the spacer member 8 and the auxiliary spacer member 22 were formed as ring shapes running continuously along the outer periphery of the back cover 6 were described. However, the present invention is not limited to such configurations, and, for example, the spacer member 8 and the auxiliary spacer member 22 may also be provided partially along the outer surface of the back cover 6. Even in configurations wherein the spacer member 8 and the auxiliary spacer member 22 are provided partially, the mutual contact between the case body 3 and the back cover 6, and additionally the mutual contact between the back cover 6 and the ring members 21 and 31, are prevented. Specifically, gaps are provided by the partial spacer member 8 and the partial auxiliary spacer member 22 between the case body 3 and the back cover 6, and additionally between the back cover 6 and the ring members 21 and 31, thereby insulating between the case body 3 and the back cover 6, and additionally between the back cover 6 and the ring members 21 and 31.

Fourth Embodiment

A fourth embodiment of the present invention as applied to a radio wave wrist watch will now be described with reference to FIG. 9. Furthermore, for the configuration portions of the radio wave wrist watch in accordance with the fourth embodiment that are identical to configuration portions of the radio wave wrist watch in accordance with the second embodiment illustrated in FIG. 5, identical reference numbers will be used, and the description of the portions will be omitted herein for the sake of brevity.

A wrist watch case 40 of the radio wave wrist watch in accordance with the fourth embodiment differs from the wrist watch case 20 of the radio wave wrist watch in accordance with the second embodiment in a spacer member 41, a mounting recess portion 42, a fitting projection 43, and projecting member 44. In the fourth embodiment, a spacer member 41 having insulating properties is provided on the outer periphery tip of the collar part 14 of the back cover 6. In other words, both the spacer member for providing insulation between the back cover 6 and the case body 3, as well as the spacer member for providing insulation between the back cover 6 and the ring member 21, are integrally formed as one component.

Specifically, the spacer member 41 consists of an insulating material. In addition, as shown in FIG. 9, the whole of the spacer member 41 is formed in a ring shape, and the cross sectional shape thereof is approximately like a shape of a square-edged U (like the Japanese katakana character ko). Furthermore, upon the inner periphery surface of the spacer member 41, a mounting recess portion 42 is provided. On the other hand, upon the outer periphery tip of the collar part 14 of the back cover 6, a fitting projection 43 is provided. Thus, by fitting together the mounting recess portion 42 of the spacer member 41 and the fitting projection 43 of the collar part 14 of the back cover 6, the spacer member 41 is attached to the outer periphery tip of the collar part 14 of the back cover 6. In addition, the spacer member 41 is formed such that the vertical thickness thereof is approximately equal to that of the thickness of the collar part 14 of the back cover 6, and upon the top and bottom surfaces of the spacer member 41 are respectively provided projecting members 44.

Figure 9:
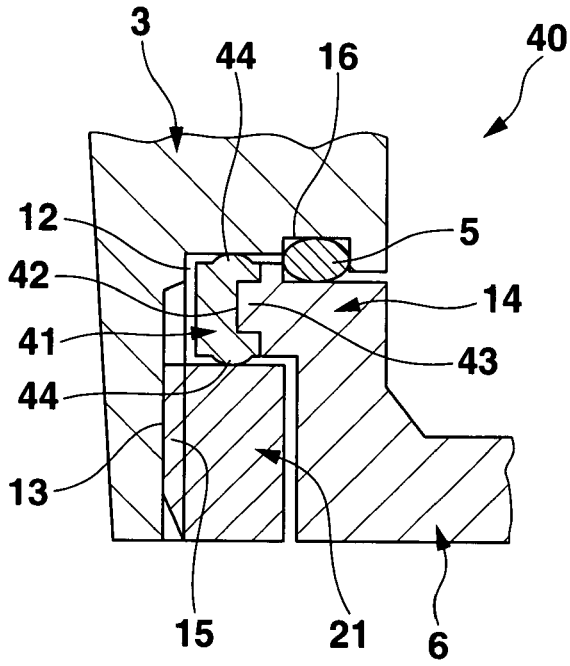
FIG. 9 is an enlarged cross section view showing the essential components of a radio wave wrist watch in accordance with the fourth embodiment of the present invention.

As shown in FIG. 9, the ring member 21 is inserted into the ring-shaped gap provided between the outer periphery surface of the back cover 6 and the inner periphery surface of the notch recess portion 12 of the case body 3, such that the inner periphery surface of the ring member 21 does not contact the outer periphery surface of the back cover 6. In this configuration, the male threads 15 of the ring member 21 are threaded and screwed into the female threads 13 provided on the inner periphery surface of the notch recess portion 12 of the case body 3, thereby attaching the ring member 21 to the case body 3. The top surface of the ring member 21 attached to the case body 3 presses the collar part 14 of the back cover 6 towards the bottom surface of the notch recess portion 12 of the case body 3 via the interposed spacer member 41. As a result, the back cover 6 is fixed to the case body 3.

In this configuration, as a result of the projecting member 44 provided on the top surface of the spacer member 41, a gap is provided between the top surface of the collar part 14 of the back cover 6 and the bottom surface of the notch recess portion 12 of the case body 3 such that these two surfaces do not contact. In addition, as a result of the projecting member 44 provided on the bottom surface of the spacer member 41, a gap is provided between the bottom surface of the collar part 14 of the back cover 6 and the top surface of the ring member 21 such that these two surfaces do not contact. Also in this configuration, a waterproof packing 5 for preventing water from entering the device between the case body 3 and the back cover 6 is provided between the top surface of the collar part 14 of the back cover 6 and the bottom surface of the notch recess portion 12 of the case body 3.

In the wrist watch case 40 in accordance with the fourth embodiment, the insulating spacer member 41 is provided extending both between the case body 3 and the back cover 6 as well as between the back cover 6 and the ring member 21. Consequently, as a result of the fourth embodiment, as in the second embodiment, insulation is provided both between the case body 3 and the back cover 6 as well as between the back cover 6 and the ring member 21. As a result, eddy current generated as a result of the magnetic field generated by the antenna 9 passing through the case body 3 and the back cover 6, in other words, the eddy current flux between the case body 3 and the back cover 6, is suppressed. As a result, even if the case body 3, the back cover 6, and the ring member 21 are all formed of metal, lowering of the signal receiving sensitivity of the antenna 9 housed inside the wrist watch case 40 is prevented.

In the wrist watch case 40 in particular, the spacer member 41 attached to the outer periphery of the collar part 14 of the back cover 6 is provided extending both between the case body 3 and the back cover 6 as well as between the back cover 6 and the ring member 21. Consequently, even if the ring member 21 is formed of metal, electrical conduction between the case body 3 and the back cover 6 via the interposed ring member 21 is prevented by the spacer member 41. As a result, when a magnetic field is generated at the antenna 9, eddy current flux between the case body 3 and back cover 6 is suppressed. In addition, as a result of the single spacer member 41, insulation is provided both between the case body 3 and back cover 6 as well as between the back cover 6 and the ring member 21. Consequently, as a result of the fourth embodiment, the number of components for spacer members is minimized, and therefore costs can be lowered.

Fifth Embodiment

A fifth embodiment of the present invention as applied to a radio wave wrist watch will now be described with reference to FIG. 10. Furthermore, for the configuration portions of the radio wave wrist watch in accordance with the fifth embodiment that are identical to configuration portions of the radio wave wrist watch in accordance with the second embodiment illustrated in FIG. 5, identical reference numbers will be used, and the description of the portions will be omitted herein for the sake of brevity.

A wrist watch case 60 of the radio wave wrist watch in accordance with the fifth embodiment differs from the wrist watch case 20 of the radio wave wrist watch in accordance with the second embodiment in spacer members 61 and through holes 62. In the fifth embodiment, the spacer members 61 are respectively provided projecting upwards and downwards at a plurality of locations on the collar part 14 of the back cover 6. In other words, the spacer members 61 are provided partially along the outer periphery of the back cover 6. The upper edges of the spacer members 61 contact the bottom surface of the notch recess portion 12 of the case body 3. In addition, the bottom edges of the spacer members 61 contact the top surface of the ring member 21.

Specifically, the through holes 62 are provided vertically penetrating a plurality of locations, respectively, on the collar part 14 of the back cover 6. The spacer members 61 consist of an insulating material. In addition, the spacer members 61 are respectively formed in screw shapes, as shown in FIG. 10. The spacer members 61 are inserted, threaded, and screwed into the through holes 62 provided at a plurality of locations on the collar part 14 of the back cover 6, thereby being provided projecting upwards and downwards from the collar part 14. As a result, the upper edges of the spacer members 61 contact the bottom surface of the notch recess portion 12 of the case body 3, thereby forming a gap between the bottom surface of the notch recess portion 12 of the case body 3 and the top surface of the collar part 14 of the back cover 6. In addition, the bottom edges of the spacer members 61 contact the top surface of the ring member 21, thereby forming a gap between the top surface of the ring member 21 and the bottom surface of the collar part 14 of the back cover 6.

Figure 10:
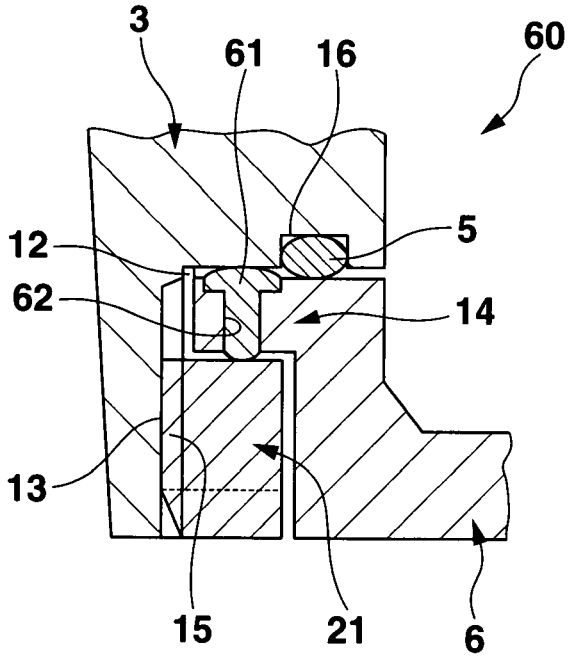
FIG. 10 is an enlarged cross section view showing the essential components of a radio wave wrist watch in accordance with the fifth embodiment of the present invention.

As shown in FIG. 10, the ring member 21 is inserted into the ring-shaped gap provided between the outer periphery surface of the back cover 6 and the inner periphery surface of the notch recess portion 12 of the case body 3, such that the inner periphery surface of the ring member 21 does not contact the outer periphery surface of the back cover 6. In this configuration, the male threads 15 of the ring member 21 are threaded and screwed into the female threads 13 provided on the inner periphery surface of the notch recess portion 12 of the case body 3, thereby attaching the ring member 21 to the case body 3. The top surface of the ring member 21 attached to the case body 3 contacts the bottom edges of the spacer members 61, and via the spacer members 61 threaded and screwed into the back cover 6, presses the collar part 14 of the back cover 6 towards the bottom surface of the notch recess portion 12 of the case body 3. As a result, the back cover 6 is fixed to the case body 3.

As a result of the upper edges of the spacer members 61 projecting from the top surface of the collar part 14, contact between the top surface of the collar part 14 of the back cover 6 and the bottom surface of the notch recess portion 12 of the case body 3 is prevented. In addition, as a result of the bottom edges of the spacer members 61 projecting from the bottom surface of the collar part 14, contact between the bottom surface of the collar part 14 of the back cover 6 and the top surface of the ring member 21 is prevented. Also in this configuration, a waterproof packing 5 for preventing water from entering the device between the case body 3 and the back cover 6 is provided between the top surface of the collar part 14 of the back cover 6 and the bottom surface of the notch recess portion 12 of the case body 3.

In the wrist watch case 60 in accordance with the fifth embodiment, the insulating spacer members 61 are provided both between the case body 3 and the back cover 6 as well as between the back cover 6 and the ring member 21. Consequently, as a result of the fourth embodiment, as in the second embodiment, insulation is provided both between the case body 3 and the back cover 6 as well as between the back cover 6 and the ring member 21. As a result, eddy current generated as a result of the magnetic field generated by the antenna 9 passing through the case body 3 and the back cover 6, in other words, the eddy current flux through the case body 3 and the back cover 6, is suppressed. As a result, even if the case body 3, the back cover 6, and the ring member 21 are all formed of metal, lowering of the signal receiving sensitivity of the antenna 9 housed inside the wrist watch case 60 is prevented.

In the wrist watch case 60 in particular, the spacer members 61 are respectively provided projecting upwards and downwards at a plurality of locations on the collar part 14 of the back cover 6. As a result, the upper edges of the spacer members 61 contact the bottom surface of the notch recess portion 12 of the case body 3. In addition, the bottom edges of the spacer members 61 contact the top surface of the ring member 21. In other words, the spacer members 61 are provided extending both between the case body 3 and the back cover 6 as well as between the back cover 6 and the ring member 21. Consequently, even if the ring member 21 is formed of metal, electrical conduction between the case body 3 and the back cover 6 via the interposed ring member 21 is prevented by the spacer members 61. As a result, when a magnetic field is generated at the antenna 9, eddy current flux between the case body 3 and back cover 6 is reliably suppressed.

In the foregoing description of the first through the fifth embodiments and variants thereof, configurations wherein the spacer members 8, 41, 51, and 61, and additionally the auxiliary spacer member 22, were formed of an insulating material were discussed. However, it should be appreciated that it is not strictly necessary for the spacer members and the auxiliary spacer member to be formed of an insulating material. For example, the spacer member in any of the foregoing embodiments may be formed of a material with high electric resistance, and/or the contact area of the spacer member with the case body 3 and back cover 6 may be reduced. As a result, the electric resistance between the case body 3 and back cover 6 increases, and the eddy current generated as a result of the magnetic field generated by the antenna 9 passing through the case body 3 and the back cover 6, in other words, the eddy current flux between the case body 3 and back cover 6, is suppressed.

In addition, in the configuration where the contact area of the spacer member with the case body 3 and the back cover 6 is reduced, the spacer member may be formed of materials with lower electric resistance, to the extent that the electric resistance between the case body 3 and the back cover 6 is still greater than that of the configuration wherein the case body 3 and the back cover 6 are in direct contact.

Furthermore, in the foregoing description of the first through the fifth embodiments and variants thereof, the configuration wherein the present invention is applied to a radio wave wrist watch was described. However, it should be appreciated that it is not strictly necessary for the present invention to be applied to a radio wave wrist watch. For example, the present invention may be applied to a variety of timepieces, such as travel watches, alarm clocks, table clocks, and wall-mounted clocks. Moreover, the present invention is not to be limited to timepieces, and may also be applied to electronic devices such as mobile phones and personal digital assistants (PDAs). More specifically, the wrist watch case of the radio wave wrist watch in accordance with the above-described first through fifth embodiments may also be applied to the watch case of a radio controlled watch, the equipment case of an electronic device, and the like.

What is claimed is:

1. An equipment case, comprising:

a metal case body which is provided with an opening, and which houses an antenna inside the case body;

a metal cover which covers the opening of the case body;

a spacer member which increases an electric resistance between the case body and the cover, and which is provided between the case body and the cover;

a metal ring member which is screwed to the case body, and which fixes the cover to the case body by pressing the cover against the spacer member towards the case body; and an auxiliary spacer member which is provided between the ring member and the cover to increase the electric resistance between the case body and the cover;

wherein the spacer member and the auxiliary spacer member are formed integrally as one component and provided extending both between the case body and the cover as well as between the cover and the ring member.

2. The equipment case according to claim 1, wherein the case body has a notch on an inner periphery edge of the opening and a first screw member on an inner periphery surface of the notch, wherein the ring member has a second screw member screwed with the first screw member on an outer periphery surface, wherein an outer periphery of the cover is disposed between a bottom surface of the notch of the case body and a top surface of the ring member, and wherein the top surface of the ring member presses the outer periphery of the cover against the spacer member towards the bottom surface of the notch of the case body.

3. The equipment case according to claim 1, wherein the spacer member insulates between the case body and the cover.

4. The equipment case according to claim 1, wherein the spacer member is provided continuously along an outer periphery of the cover.

5. The equipment case according to claim 4, wherein the spacer member is a waterproof packing for preventing water from entering between the case body and the cover.

6. The equipment case according to claim 1, wherein the spacer member is provided partially along an outer periphery of the cover.

7. The equipment case according to claim 1, further comprising:

a collar part which is provided on an outer periphery of the cover; and a stepped recess portion which is provided on the ring member;

wherein the collar part is inserted into the stepped recess portion.

8. The equipment case according to claim 1, wherein the auxiliary spacer member insulates between the ring member and the cover.

9. The equipment case according to claim 1, wherein the auxiliary spacer member is provided partially along an outer periphery of the cover.

10. A wrist watch case, comprising:

a metal case body which is provided with an opening, and which houses an antenna for receiving a standard time radio wave and a watch module for correcting time based on the standard time radio wave received by the antenna inside the case body;

a metal cover which covers the opening of the case body;

a spacer member which increases an electric resistance between the case body and the cover, and which is provided between the case body and the cover;

a metal ring member which is screwed to the case body, and which fixes the cover to the case body by pressing the cover against the spacer member towards the case body; and an auxiliary spacer member which is provided between the ring member and the cover to increase the electric resistance between the case body and the cover;

wherein the spacer member and the auxiliary spacer member are formed integrally as one component and provided extending both between the case body and the cover as well as between the cover and the ring member.

11. The wrist watch case according to claim 10, wherein the case body has a notch on an inner periphery edge of the opening and a first screw member on an inner periphery surface of the notch, wherein the ring member has a second screw member screwed with the first screw member on an outer periphery surface, wherein an outer periphery of the cover is disposed between a bottom surface of the notch of the case body and a top surface of the ring member, and wherein the top surface of the ring member presses the outer periphery of the cover against the spacer member towards the bottom surface of the notch of the case body.

12. The wrist watch case according to claim 10, wherein the spacer member insulates between the case body and the cover.

13. The wrist watch case according to claim 10, wherein the spacer member is provided continuously along an outer periphery of the cover.

14. The wrist watch case according to claim 13, wherein the spacer member is a waterproof packing for preventing water from entering between the case body and the cover.

15. A radio controlled watch, comprising:

a watch case, having:

a metal case body which is provided with an opening;

a metal cover which covers the opening of the case body;

a spacer member which increases an electric resistance between the case body and the cover, and which is provided between the case body and the cover;

a metal ring member which is screwed to the case body, and which fixes the cover to the case body by pressing the cover against the spacer member towards the case body; and an auxiliary spacer member which is provided between the ring member and the cover to increase the electric resistance between the case body and the cover;

wherein the spacer member and the auxiliary spacer member are formed integrally as one component and provided extending both between the case body and the cover as well as between the cover and the ring member;

an antenna which receives a standard time radio wave, and which is housed inside the watch case; and a watch module which corrects time based on the standard time radio wave received by the antenna.

16. The radio controlled watch according to claim 15, wherein the watch case is adapted to be worn on an arm by a band.

* * * * *